US005185715A

United States Patent [19]

Zikan et al.

[11] Patent Number: 5,185,715

[45] Date of Patent: Feb. 9, 1993

[54] DATA PROCESSING SYSTEMS AND METHODS FOR LINEAR PROGRAMMING

[75] Inventors: Karel Zikan, Seattle; Thomas P. Caudell, Issaquah, both of Wash.

[73] Assignee: Hughes Aircraft Company, Los Angeles, Calif.

[21] Appl. No.: 502,343

[22] Filed: Mar. 30, 1990

[51] Int. Cl.[5] ..... G06G 7/00

[52] U.S. Cl. ..... 364/807; 364/841; 364/822; 364/845; 364/837

[58] Field of Search ..... 364/402, 602, 604, 606, 364/807, 819, 820, 822, 845, 837, 841, 713, 754, 757, 759, 760; 379/113, 221

[56] References Cited

U.S. PATENT DOCUMENTS

| | | | |
|---|---|---|---|
| 4,697,247 | 9/1987 | Grinberg et al. | 364/713 |
| 4,744,026 | 5/1988 | Varderbei | 364/402 |
| 4,744,027 | 5/1988 | Bayer et al. | 364/402 |
| 4,744,028 | 5/1988 | Karmarkar | 364/402 |
| 4,747,069 | 5/1988 | Grinberg et al. | 364/807 |
| 4,764,891 | 8/1988 | Grinberg et al. | 364/807 |
| 4,800,519 | 1/1989 | Grinberg et al. | 364/822 |
| 4,843,587 | 6/1989 | Schlunt et al. | 364/822 |
| 4,914,563 | 4/1990 | Karmarkar et al. | 364/402 |

FOREIGN PATENT DOCUMENTS 1366830 6/1964 France .

OTHER PUBLICATIONS

Proceedings of the 1988 International Conference on Parallel Processing, Aug. 15-19, 1988, vol. III Algorithms and Applications, pp. 264-271, The Pennsylvania State University Press, University Park, U.S., C. B. Stunkel.

R. A. Athale and W. C. Collins, "Optical matrix Multiplier Based on Outer Product Decomposition", Applied Optics, 21, pp. 2089 (1982).

Sotter et al., "Programmable Real Time Incoherent Matrix Multiplier for Optical Processing", Applied Optics, 25, pp. 2295-2305 (1906).

V. N. Faddeeva, *Computational Method of Linear Algebra*, Dover Publications, New York, N.Y. (1959).

K. G. Murty, Linear Complementarity Problem, Linear and Nonlinear Programming, Heldermann Verlag, Berlin, 1988.

*Primary Examiner*—Jerry Smith
*Assistant Examiner*—Jim Trammell
*Attorney, Agent, or Firm*—E. E. Leitereg; V. D. Duraiswamy; W. K. Denson-Low

[57] ABSTRACT

Data processing systems are described for processing linear programming problems. The invention employs optical (100) or digital (150) processors to perform Gaussian pivot operations by performing outer product matrix operations in parallel. The present invention can solve linear programming problems utilizing various techniques, including the Simplex and Karmarkar algorithms. This results in a greatly improved speed in solving linear programs over prior techniques involving sequential computing.

15 Claims, 8 Drawing Sheets

DATA PROCESSING SYSTEMS AND METHODS FOR LINEAR PROGRAMMING

BACKGROUND OF THE INVENTION

1. Technical Field

This invention relates to parallel processing systems and, in particular, to outer product processors capable of solving linear programming problems.

2. Discussion

Linear programming is an application of linear algebra that has been developed within the last 40 years as a technique for economic planning and decision making. Stated concisely, a central problem of management is to utilize available resources for the production of goods and the provision of services in such a way that specified objectives are achieved in the best possible manner. The available resources can include raw materials, labor supply, energy resources, planned capacity, and distribution methods among others. Goods and services can include manufactured products, agricultural output, transportation and communication, as well as health care and other needs of society. A specific objective of management might be to maximize employment or profit or production or to minimize costs or delivery time or fuel consumption. Executing such activity typically is subject to various quantitative constraints, such as a limited supply of raw materials, skilled workers, or machine capacity. Constraints can also be imposed by contractual agreements and standards of quality of the finished products.

The above problems can frequently be expressed as a linear programming problem in the following form:

$$\text{maximize} \sum_{j=1}^{n} = c_j x_j$$

$$\text{subject to} \sum_{j=1}^{n} a_{ij} x_{ij} \leqq b_i \; (i = 1, 2 \ldots m)$$

$$x_j \geqq 0 \; (j = 1, 2 \ldots n)$$

Feasible regions of the above problem define a convex polyhedron; the problem then is to find the point on the convex polyhedron where the function assumes its maximum (or minimum) value.

The field of linear programming was essentially created in 1946, when G. B. Dantzig defined its scope and proposed the first, and still most widely used, method for the practical solution of linear programming problems, called the Simplex method. Currently, the most common linear programming codes are careful "sparse" implementations of the so-called revised Simplex method and, more recently, of the barrier (Karmarkar) interior point method.

In business, the most common linear programming problems share common features (sparsity, structure) and usually need not be solved in real time. However, linear programming is also applicable to many problems in robotics (motion planning, computer vision), industry (navigation and onboard computing, dynamic resource allocation), and tactical business decisions (stocks and other in-time business decisions). These problems, although typically smaller (in terms of constraints and variables) than the former type of linear programs, often are dense and need to be solved in a "real" time.

The revised Simplex method and, more recently, the barrier, (Karmarkar) interior point method are capable of solving some very large (in terms of dimensions) linear programs in the course of several hours. The linear programs so solved, are invariably sparse and structured, which allows for the numerous time saving heuristics that are used. However, without the sparsity, even the moderately sized problems are often intractable in the required amount of time. Thus, it would be desirable to provide a system and method for solving dense linear programming problems that are in real time.

Also, current procedures for solving linear programming problems typically involve signals that are propagated sequentially. Due to the large number of steps required to solve many liner programming problems, it would be desirable to provide a system to perform linear programming processing in parallel rather than sequentially.

SUMMARY OF THE INVENTION

The general purpose of the present invention is to provide an optimized procedure for solving linear programming problems in a parallel architecture computer, either digital or optical, that is generally capable of handling two-dimensionally structured data sets.

In accordance with the teachings of one embodiment of the present invention there is shown an apparatus for processing linear programming problems, comprising an input means for receiving signals representing the elements of the linear programming problem. A storage means then stores the elements received by the input means in matrix form. A processor means performs a series of matrix operations on the elements to reach a solution to said linear programming problem. This is done by utilizing a plurality of processing elements for simultaneously performing a series of complete matrix operations on the elements. Also, an output means transmits the solution of the linear programming problem.

In accordance with the teachings of another embodiment of the present invention a method of processing linear programming problems is described. First, signals representing the elements of said linear programming problem are received. Then the elements received are stored in matrix form. Next, a series of matrix operation are performed on the elements to reach a solution to the linear programming problem, by simultaneously performing a series of complete matrix operations. Finally, a solution of the linear programming problem is transmitted.

An advantage of the present invention is that it provides a high speed processor for solving general linear programming problems.

Another advantage of the present invention is that it may be implemented either as a digital or optical processor.

BRIEF DESCRIPTION OF THE DRAWINGS

The various advantages of the present invention will become apparent to those skilled in the art after reading the following specification and by reference to the drawings which.

DESCRIPTION OF THE PREFERRED EMBODIMENTS

Generally stated, the present invention is a system and method by which a highly parallel data processing architecture can be optimally utilized to solve linear programming problems. This parallel computer architecture may be embodied as either an electronic or optical device. A preferred parallel optical processor architecture for use in conjunction with the present invention is disclosed in J. Grinberg, et al., U.S. Pat. No. 4,800,519, "Optical Data Processing Systems and Methods for Matrix Inversion, Multiplication, and Addition", filed Mar. 5, 1986, assigned to the assignee of the present patent application. A preferred parallel digital electronic processor architecture for use in conjunction with the present invention is disclosed in J. Grinberg, et al., U.S. Pat. No. 4,697,247, "Method of Performing Matrix by Matrix Multiplication", filed Jan. 14, 1986, assigned to the assignee of the present patent application. Both of the aforementioned patents are incorporated by reference herein.

I. Overview of the Optical Data Processor Architecture

Figure 1:
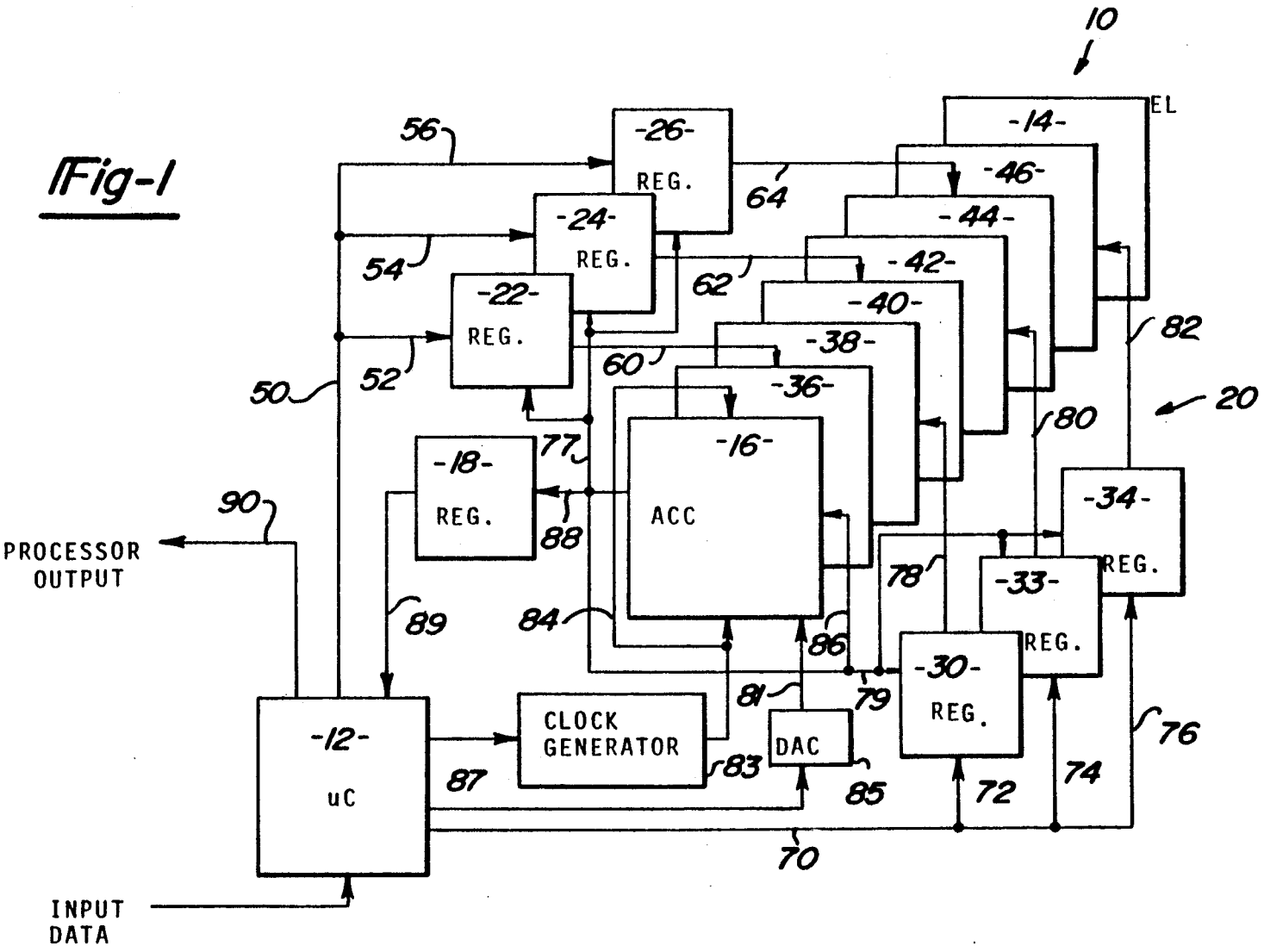
FIG. 1 is a block diagram of an optical data processing system in accordance with the first embodiment of the present invention.

The generalized system embodiment for use with the present invention, indicated by the reference numeral 10, is shown in FIG. 1. In particular, the preferred multistage optical data processor (ODP), generally indicated by the reference numeral 20, is operatively supported by a microcontroller 12 and interface registers 18, 22, 24, 26, 30, 33 and 34. The principal operative components of the ODP are shown in FIG. 1 as including flat panel or LED light source 14, matrix array accumulator 16 (also referred to as a detector array), and a plurality of spatial light modulators (SLMs) 36, 38, 40, 42, 44 and 46. Preferably, the light source 14, accumulator 16 and the SLMs 36, 38, 40, 42, 44, 46 are provided in closely adjacent parallel planes with respect to one another such that a relatively uniform beam generated by the light source 14 travels through each of the spatial light modulators in succession and is ultimately received by the accumulator 16.

The light beam is effectively used as a data transport mechanism acquiring data provided by each of the spatial light modulators that is subsequently delivered to the accumulator 16. The operation of each of the spatial light modulators can be explained in terms of their spatial transmissivity variation with respect to corresponding spatially distributed activating voltage potentials. To a first approximation at least, the light amplitude transmissivity of a spatial light modulator is directly proportional to the applied voltage potential. Thus, the combined transmissivity (TO) of two serially coupled spatial light modulators is proportional to the product of the respective transmissivities T1, T2 of the spatial light modulators. The combined transmissivity TO can thus be written as:

$$TO = T1 \times T2 \quad (1)$$

$$TO = C \times D \times V1 \times V2 \quad (2)$$

Where V1 and V2 are the respectively applied voltage potentials, and C and D are the transmissivity to applied voltage coefficients for the respective spatial light modulators. Where an extended series of spatial light modulators are serially coupled, in accordance with the present invention, the combined transmissivity TO of the multistage spatial light modulator stack is proportional to the product of the respective transmissivities of the individual spatial light modulators. A light beam sourced by the flat panel 14 can thus be directed to acquire spatially distributed data corresponding to the spatially distributed relative transmissivities of each of the spatial light modulators 36, 38, 40, 42, 44 and 46.

Spatially relatable data is provided to the spatial light modulators 36, 38, 40, 42, 44 and 46 via the interface registers 22, 24, 26, 30, 33 and 34. These registers preferably provide high speed data storage and signal conditioning. They may also include arithmetic processors to perform functions such as numerical inversion. As will be discussed in greater detail below, the stack of spatial light modulators preferably includes a plurality of one-dimensional spatial light modulators. As shown in FIG. 1, one-dimensional spatial light modulators 36, 38, 40, 42, 44 and 46 are coupled to respective registers 22, 30, 24, 33 and 26 via interface data lines 60, 78, 62, 80, 64 and 82.

The interface registers 22, 24, 26, 30, 33 and 34, in turn, preferably receive data in a parallel form from the accumulator 16 via busses 77 and 79. The microcontroller 12 via the processor control buses 50, 70 provides the control signals. While the processor control buses 50, 70 are shown as separate and respectively connected to the registers by the register control lines 52, 54, 56, 72, 74 and 76, the interface registers may alternately be coupled via control multiplexers to a single, common control bus driven by the microcontroller 12. In either case, however, it is essential only that the microcontroller 12 possess sufficient control over the registers 22, 24, 26, 30, 32 and 34 to selectively provide its predetermined data thereto.

The optical data processor system 10 is completed with the provision of the output register 18 coupled between the accumulator 16 and the controller 12. The accumulator 16 itself may be included as part of a matrix array of photosensitive devices 17 (FIG. 2) capable of converting incident light intensity into a corresponding voltage potential (or electrical charge) representative of the data beam at an array resolution at least matching that of the spatial light modulators 36, 38, 40, 42, 44 and 46. Alternatively, the accumulator 16 may be separate from the detector array 17. As will be described in greater detail below, the accumulator 16 accumulates light beam data that can then be shifted by means of a clock signal supplied by a clock generator 83 to the data output register 18 via the output interface bus 88. The accumulator 16 also includes circular shift bus 86 and lateral shift bus 84 to permit a wide variety of storage, shift and subtraction operations to be performed within the accumulator 16 during the operation of the optical data processor 20.

The data output register 18 is preferably a high speed analog-to-digital converter, shift register and buffer that channels the shifted output data from the accumulator 16 to the processor via the data bus 89. Initializing data from the controller 12 may be stored in the accumulator 16 via data line 87 and digital-to-analog converter 85.

As should be well apparent from the foregoing, the microcontroller 12 possesses full control over the optical data processor 20. Any desired data can be provided to any specific combination of spatial light modulators to implement a desired data processing algorithm. One particular facility is that only those spatial light modulators required for the performance of any particular optical data processing algorithm need be actively utilized in the optical data processor 20 in accordance with the present invention. Spatial light modulators within the optical data processor 20 may be provided with appropriate data via their respective data registers to uniformly maintain the spatial light modulators at their maximum transmissivity. Consequently, selected spatial light modulators may be effectively removed from the optical data processor by their appropriate data programming. Thus, the optical data processing system 10 provides an extremely flexible environment for the performance of optical data processing computations.

Figure 2:
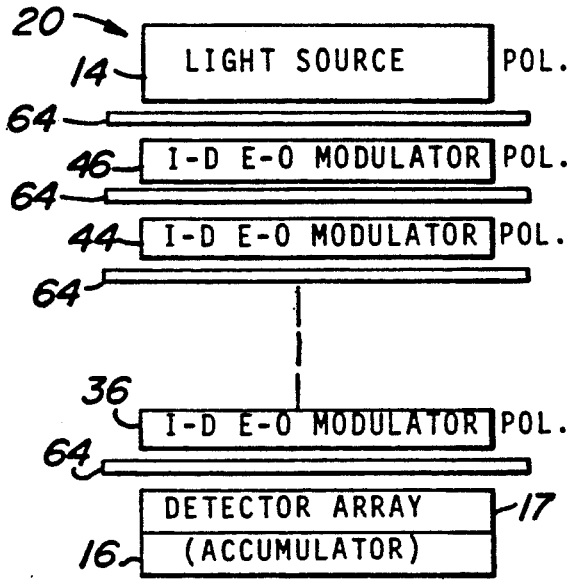
FIG. 2 is a side view of an optical data processor constructed in accordance with the present invention.

A suitable structure for the optical data processor 20 is shown in FIG. 2. The embodiment shown is exemplary as including substantially all of the principle components that may be incorporated into any preferred embodiment of the optical processor.

The components of the optical data processor include the light source 14, SLM stages 36 through 46 and detector array 16. The flat panel light source 14 is preferably an electroluminescent display panel, or alternately, a gas plasma display panel or LED or LED array or laser diode or laser diode array. A diffuser (not shown) may be utilized to grade the light produced by the flat display panel into a spatially uniform optical beam.

The bulk of the optical data processor 20 is formed by a serial stack of SLM stages, of which SLM stage 46 is representative. Preferably, the SLM is a rigid structure requiring no additional support. In such embodiment, the SLMs may be placed immediately adjacent one another, separated only by a thin insulating optically transparent layer, yielding an optimally compact multistage stack of spatial light modulators. In embodiments where the operation of the spatial light modulator is accomplished through the polarization modulation of the light beam, polarizers 64 are preferably interposed between the SLMs. The polarizer 64 further permits the utilization of an unpolarized optical data beam source 14 in local polarization vector data representation embodiments of the present invention. If the principle of operation of the spatial light modulators is light absorption (instead of polarization rotation), then there is no need for the polarizers.

The accumulator 16 is preferably included as part of a solid state matrix array of optical detectors 17. In particular, the optical detector array 17 is preferably a shift register array of conventional charge coupled devices (CCDs) provided at an array density equivalent to the effective resolution of the optical data processor 20. The use of a CCD array is preferred both for its charge accumulation, i.e. data summing, capability as well as for the ease of fabricating CCD shift register circuitry than can be directly controlled by the microcontroller 12. Further the use of the CCD array permits substantial flexibility in the operation of the accumulator 16 by permitting data shifted out of the accumulator 16 and onto the data return bus 88 to be cycled back into the accumulator 16 via the circular shift data bus 86. Additionally, the accumulator 16 possesses the desirable flexibility through the use of adjacent register propagation path interconnections to permit lateral cycling of the data contained therein via the lateral shift data bus 84 as indicated in FIG. 1. Consequently, the accumulator 16 can be effectively utilized in the execution of quite complex optical data processing algorithms involving shift and sum operations under the direct control of the microcontroller 12.

Figure 3:
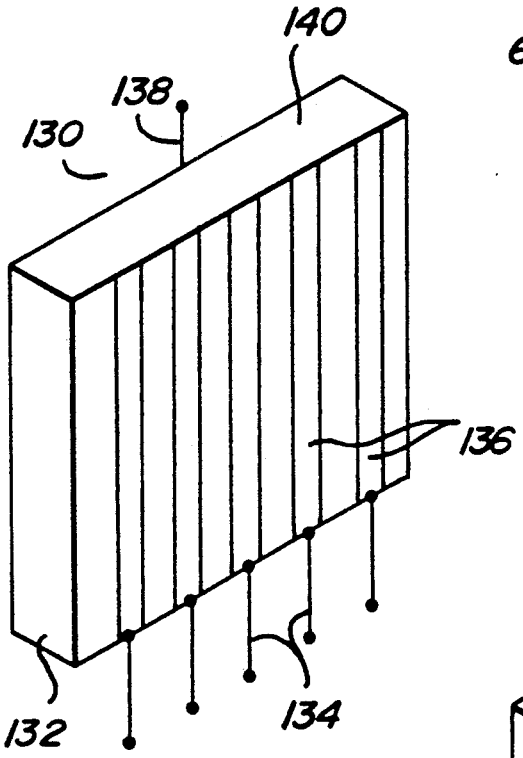
FIG. 3 is a perspective view of an electro-optical spatial light modulator for use in the present invention.
Figure 4:
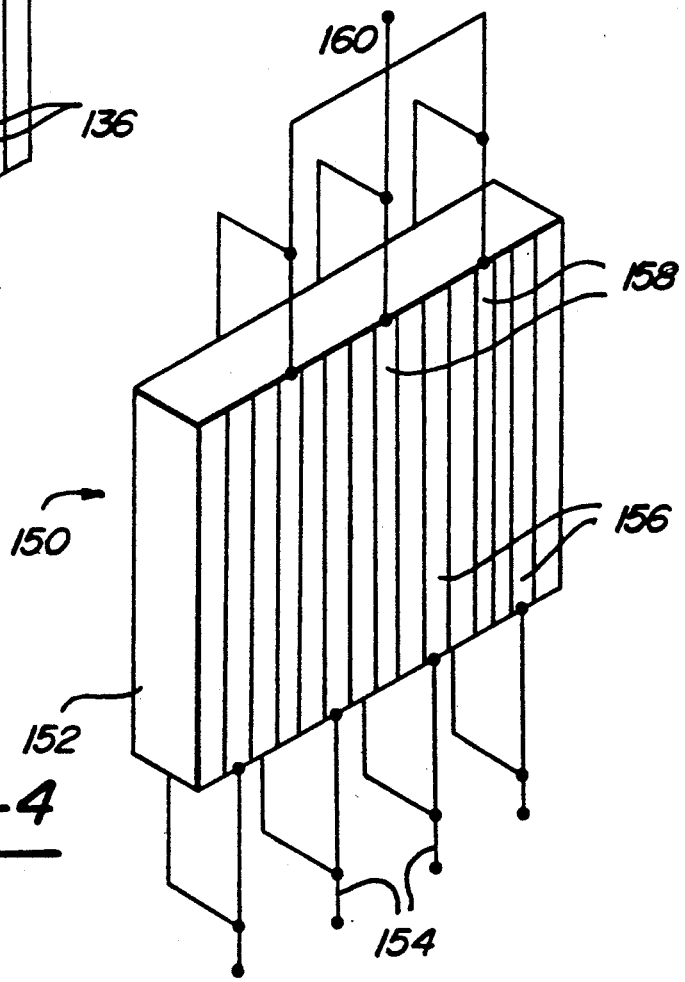
FIG. 4 is a perspective of another electro-optical spatial light modulator for use in the present invention.

Two preferred embodiments of one-dimensional spatial light modulators are shown in FIGS. 3 and 4, respectively. The spatial light modulator 130 shown in FIG. 3 includes an electro-optic element 132 preferably having two major parallel opposing surfaces upon which stripe electrodes 136 and potential reference plan 140 are provided, respectively. The electro-optic element 132 may be a transmission mode liquid crystal optical material, such as $KD_2PO_4$ or $BaTiO_3$. This latter material polarization modulates light locally in proportion to the longitudinal and transverse voltage potential applied across the portion of the material that the light passes through. This material characteristically possesses sufficient structural strength to be adequately self-supporting for purposes of the present invention when utilized as electro-optic elements 132 and may be provided at a thickness approximately 5 to 10 mils for a major surface area of approximately one square inch.

As the active regions of the electro-optical element 132 necessarily lay between each of the stripe electrodes 136 and the reference plane electrode 140, the electrodes 136, 140 are preferably of a high conductivity transparent material such as indium tin oxide. Contact to the electrodes 136, 140 is preferably accomplished through the use of separate electrode leads 134, 138, respectively, that are attached using conventional wire bonding or solder bump interconnect technology.

FIG. 4 illustrates an alternate one-dimensional spatial light modulator. This spatial light modulator differs from that of FIG. 3 by the relative placement of the signal 156 and potential reference 148 electrodes on the two major surfaces of the electro-optical element 152. On each major surface, a reference potential electrode 158 is interposed between pairs of the signal electrodes 156 to form an interdigitated electrode structure that is essentially identical on both major surfaces of the electro-optic element 152. The active portions of the electro-optic element 152 lie between each of the signal electrodes 156 and their surface neighboring reference potential electrodes 158.

Thus, the achievable electro-optic effect is enhanced through the utilization of both surfaces of the electro-optic element 152. Further, as the active portions of the electro-optic element 152 are not shadowed by the signal electrodes 156, all of the electrodes 156, 158 may be of an opaque conductive material, such as aluminum that may be further advantageously utilized to effectively mask the active regions of the electro-optic element 152. That is, the electrodes 156, 158 may be utilized to block the respective pixel edge portions of the data beam as they diverge while passing through the electro-optic element 152.

Similar to the spatial light modulators 13 of FIG. 3, the electro-optic element 152 may be either a liquid crystal light valve or a solid state electro-optic material. For reasons of faster electro-optic response time, greater structural strength, and ease of fabrication, transverse field polarization modulator electro-optic materials, such as represented by $LiNbO_3$, $LiTaO_3$, $BaTiO_3$, $Sr_xBa_{(1-x)}NdO_3$ and PLZT are preferred.

The operation of an optical data processing system of the type described above is best understood by analyzing its operation in performing matrix multiplication. R. A. Athale and W. C. Collins, in their paper "Optical Matrix-matrix Multiplier Based on Outer Product Decomposition", Applied Optics 21, pg. 2089 (1982), have described the principle of outer product decomposition for optical matrix multiplication.

Thus, the product matrix C of two matrices B and A is given by $$C=BA$$

where the ij-th element of C is given by the inner product between the i-th row vector of B and the j-th column vector of A:

$$C_{ij} = \sum_m b_{im}a_{mj}$$

However, C can also be written as a sum of matrices, each of which is the outer product between a column vector of B and the corresponding row vector of A. The principle behind an outer product matrix multiplier is to sequentially provide the rows of matrix B into an SLM such as SLM 38 and the corresponding columns of matrix A into another SLM such as SLM 36 which is orthogonal to the first SLM. The transmission of the two crossed SLMs during the nth clock cycle of clock generator 83 is given by the outer product of the nth row of B and the nth column of A. The transmitted light falls on accumulator detector array 16 and is summed to form the product matrix C. The multiplication of two N×N matrices, which requires $N^3$ multiplications, is performed in N clock cycles.

Figure 5:
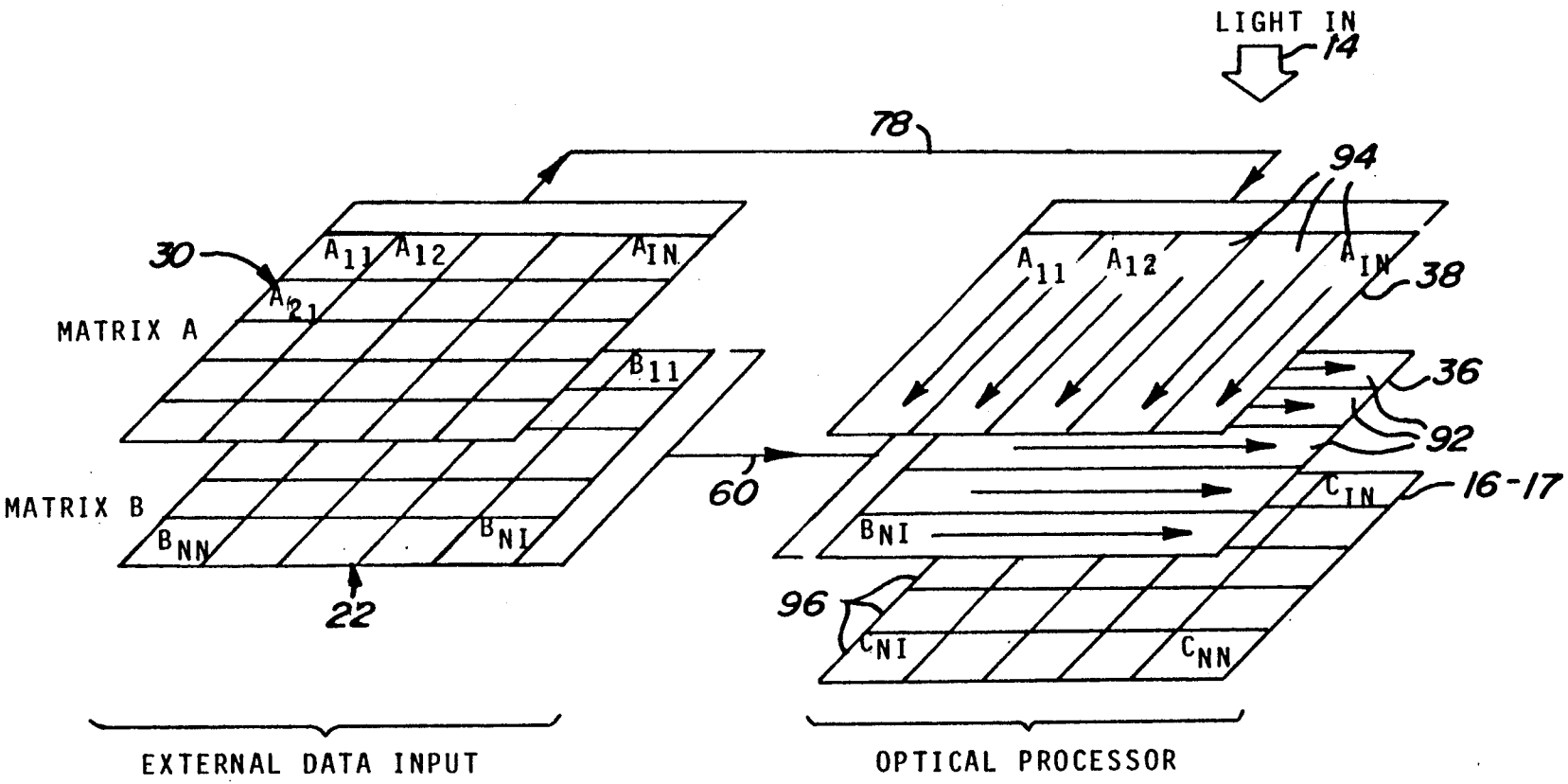
Fig-5 (PRIOR ART)
FIG. 5 is an exploded perspective schematic representation of a prior art optical data processing system for processing matrices.

FIG. 5 shows the elements of the two matrices A and B as they are provided by storage registers 30 and 22 to SLMs 38 and 36, one row and column at a time, respectively. (Polarizers which are located between the SLMs have been omitted from FIG. 5 for the sake of clarity.) The electrodes on each SLM 36, 38 divide the SLM into strip shaped regions 92, 94, hereinafter referred to as unit cells. Each cell is used to process a matrix element. During the nth clock cycle, light from source 14 is modulated in one direction by the nth row of A and in the orthogonal direction by the nth column of B, forming the nth outer product matrix at the accumulator detector array 16, 17, the sum of which is the product matrix C. Note that only two SLMs are required for the matrix multiplication operation. The array of 16, 17 is divided into cells 96, where each cell corresponds to one of the elements $C_{ij}$.

While the above described prior art optical processor works well for performing matrix multiplication, it is not designed to efficiently solve linear programming problems.

II. The Linear Programming Problem

Figure 6:
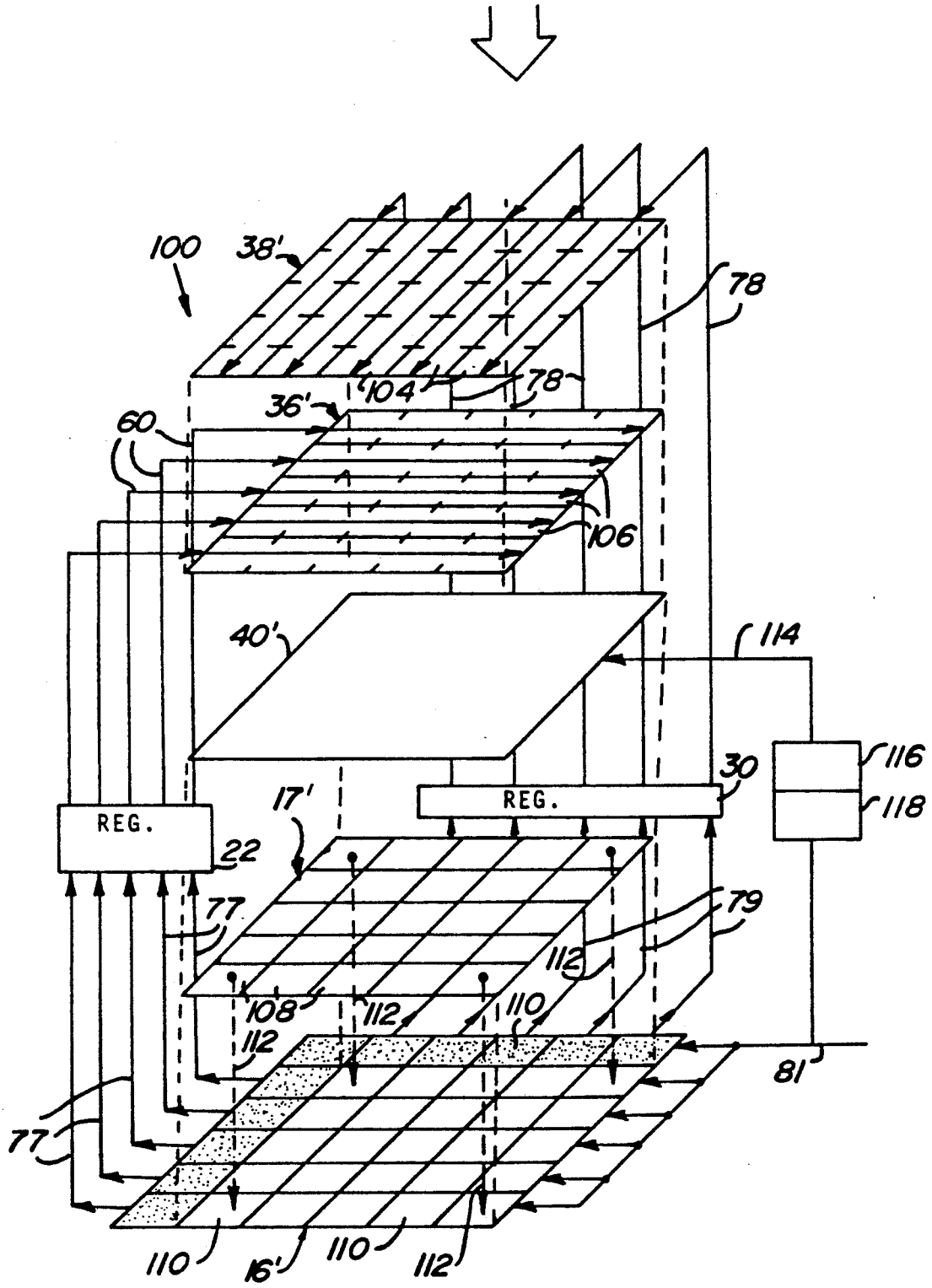
FIG. 6 is an exploded perspective schematic view of an optical processor constructed in accordance with the invention for processing linear programming problems.

FIG. 6 shows an embodiment 100 of the invention which is an optical processor for processing linear programming problems.

Before describing the specific embodiment 100, a discussion of the mathematical expressions employed in the operation of the invention will be provided. The above referenced U.S. Pat. No. 4,800,519 disclosed an optical computer that can be used to compute the so-called Schur complement $$D'=D-CA^{-1}B \tag{1}$$

of four matrices, A, B, C, and D. (Matrices B, C, and D can be rectangular, but matrix A must be nonsingular and the dimensions of the matrices must match.) If A is n×n matrix then n outer-product operations suffice to replace the block matrix:

$$M = \begin{pmatrix} A & B \\ C & D \end{pmatrix} \tag{2}$$

by the block matrix:

$$M' = \begin{pmatrix} I & A^{-1}B \\ O & D - CA^{-1}B \end{pmatrix} \tag{3}$$

Note that the bottom right hand corner of M' contains the Schur complement. In the special case $$M = \begin{pmatrix} a & b^T \\ c & D \end{pmatrix} \tag{4}$$

where a is a nonzero number, c and $b^T$ are column and row vectors respectively, and D is a matrix of the appropriate size, M' becomes $$M' = \begin{pmatrix} 1 & (1/a)b^T \\ O & D - (1/a)cb^T \end{pmatrix} \tag{5}$$

The elements of the matrix $D-(1/a)cb^T$ are of the form $$d_{ij}' = d_{ij}^{-Cibj}\alpha \tag{6}$$

which would be obtained during the familiar method of solving systems of linear equations by Gauss elimination. Thus, we term the transformation from (4) to (5) a Gaussian pivot. In compact form, the pivot on the ij entry becomes the transformation $$M \rightarrow M - \alpha_j\beta_i^T/a_{ij} \tag{7}$$

where $\beta_i^{\%}=(a_{i1}, a_{i2}, \ldots, a_{in})$ is the i-th row of M and $\alpha^T{}_j=(a_{1j}, a_{2j}, \ldots, a_{(i-1)j}, (a_{ij}-1), a_{(i+1)j}, \ldots a_{mi})$ is almost the j-th column of M, except for the modified i-th position.

Many standard matrix operations can be computed with the help of Schur complement. For instance, set the matrices (1) to D=0 and −C=B=I to obtain the inverted matrix $D'=A^{-1}$ from the Schur complement. Similarly, other special choices of A, B, C and D give $D-C$, $D+B$, CB, $A^{-1}B$, $-CA^{-1}$, and so on; such is the generality of the Schur complement concept in linear algebra. In the article "Programmable Real-Time Incoherent Matrix-Multiplier for Optical Processing", *Applied Optics*, 25, 1986, pp. 2295-2305, Soffer, et al, credit their method of inverting matrix to Faddeev. See V. N. Faddeeva, *Computational Methods of Linear Algebra*, Dover Publications, Inc., N.Y., N.Y., 1959. The Faddeev algorithm is logically equivalent to a more traditional method of inverting matrix where Gaussian pivots are applied to matrix $$M=(A\ I) \tag{8}$$

in such a way that they produce $$M'=(I\ A^{-1}) \tag{9}$$

The Schur complement manifests itself more implicitly in the transformation from (8) to (9), but it is as present as in the Faddeev algorithm; the Faddeev (and Faddeeva) method of inverting matrix differs from the traditional method by a different organization of computation.

Yet, another method of computation organization gives yet another version of Gaussian pivots; the (Gaussian) pivots with substitution. One pivot with substitution transforms the block matrix $$M=\begin{pmatrix} a & b^T \\ c & D \end{pmatrix} \tag{10}$$

to $$M'=\begin{pmatrix} 1 & (-1/a)b^T \\ (1/a)c & D-(1/a)cb^T \end{pmatrix}, \tag{11}$$

a sequence of such pivots transforms $$M=\begin{pmatrix} A & B \\ C & D \end{pmatrix} \tag{12}$$

to $$M'=\begin{pmatrix} A^{-1} & -A^{-1}B \\ CA^{-1} & D-CA^{-1}B \end{pmatrix}. \tag{13}$$

Assume that $M_{ij}$ is M except for the i-th row and j-th column which are zero. Described in its compact form, the ij entry pivot with substitution is the transformation $$M \rightarrow M_{ij}-\alpha_j\beta^T{}_i/a_{ij} \tag{14}$$

where $\beta^T{}_i=(a_{i1}, a_{i2}, \ldots, a_{i(j-1)}, 1, a_{i(j+1)}, \ldots, a_{in})$ and $\alpha^T{}_i=(a_{1j}, a_{2j}, \ldots, a_{(i-1)j}, 1, a_{(i+1)j}, \ldots, a_{mj})$ are almost the i-th row and j-th column of M, respectively. The exceptions are the respective j-th and i-th entries that are set to 1. Note the similarities and differences between (8) and (13).

To apply these concepts to the Simplex algorithm, we assume that b is a nonnegative vector, and that $$M=\begin{pmatrix} O & C^T & O^T \\ b & A & I \end{pmatrix} \tag{15}$$

Dantzig showed that a judiciously selected sequence of Gaussian pivots applied to M gives the solution of the linear program $$min\{c^Tx \mid x \geqq 0,\ Ax \leqq b\} \tag{16}$$

Since all linear programming problems can be transformed into this canonical form, Dantzig's algorithm, Simplex, solves all these problems.

Figure 7:
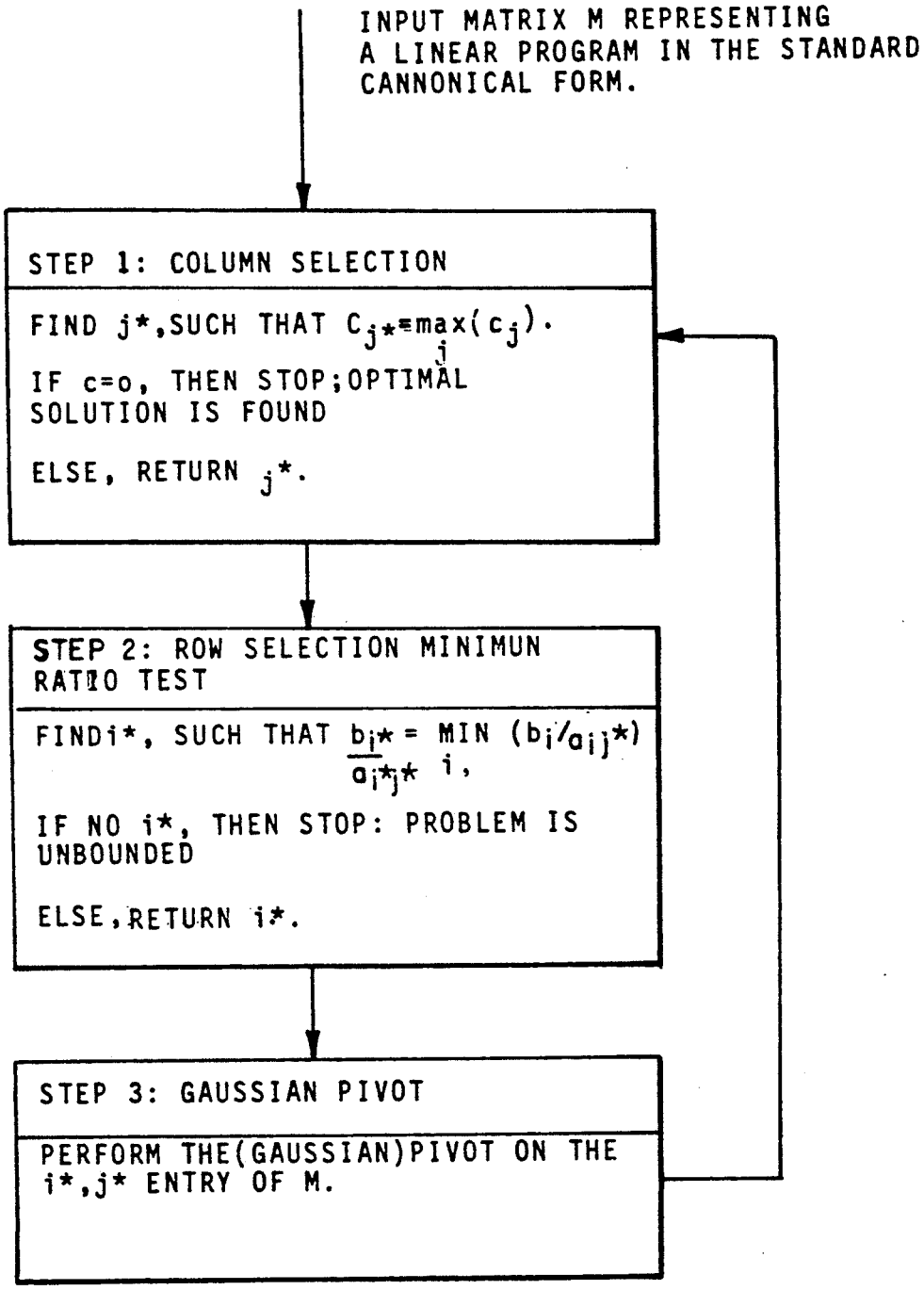
FIG. 7 is a flowchart of one iteration of the Simplex algorithm in accordance with the present invention.

There are many variants of the Simplex algorithm, but all more or less follow the general pattern set forth by the original Dantzig work. FIG. 7 shows the basic outline.

Most variations of the Simplex algorithm differ from Dantzig's version in the way the pivot columns are selected; Step 1 may even be replaced by another Step 2 as it happens for instance in Dantzig's Self-dual Simplex algorithm. Step 2 is essential to Simplex type algorithms and can not be avoided. Step 3 is also essential and, in addition, it is very time consuming; this step generally prohibits solution of large linear programming problems on sequential architectures, with the possible exception of problems with sparse structured matrices. Advanced linear programming codes usually use the so-called revised Simplex method, with Gaussian pivoting replaced either by sparse LU or QR factorization coupled with a back substitution. It should be noted that the aforementioned Karmarkar algorithm is competitive with Simplex exactly in the area of large, sparse and structured problems.

Consider one iteration of the Simplex algorithm. Because the above described outer product architectures and similar architectures are built to perform outer-product (and Gaussian pivot) operations on a grand scale, they can "cut in size" the prohibitive cost of Step 3 of Simplex algorithm. In fact, if properly implemented in the emerging electronic or electrooptical technology, the formerly formidable task of matrix transformation by a Gaussian pivot is reduced to a single operation, not unlike for instance taking a logarithm or square root of a number. Architecture is added for Steps 1 and 2 in order to solve linear programs "wholesale".

Figure 8:
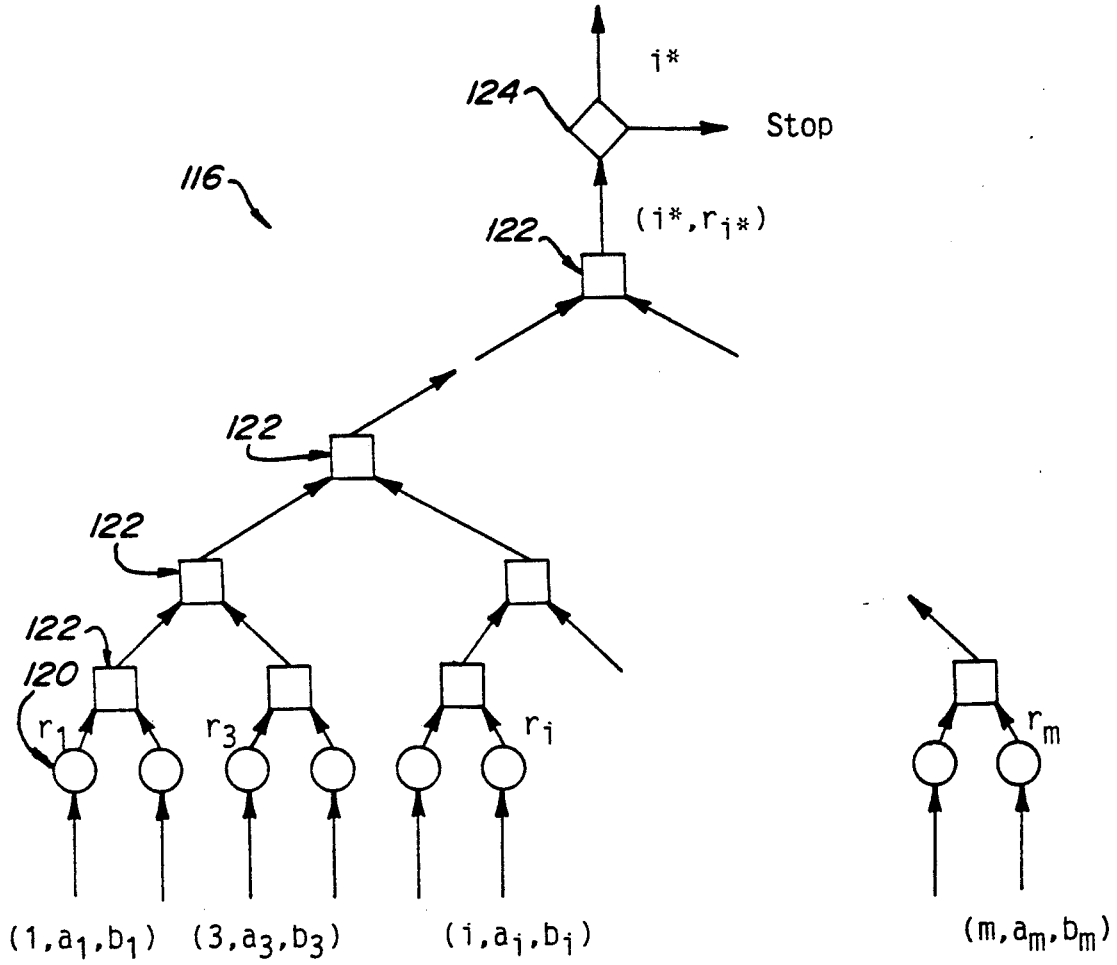
FIG. 8 is a block diagram of an architecture for performing step 1 of the flowchart shown in FIG. 7.
Figure 9:
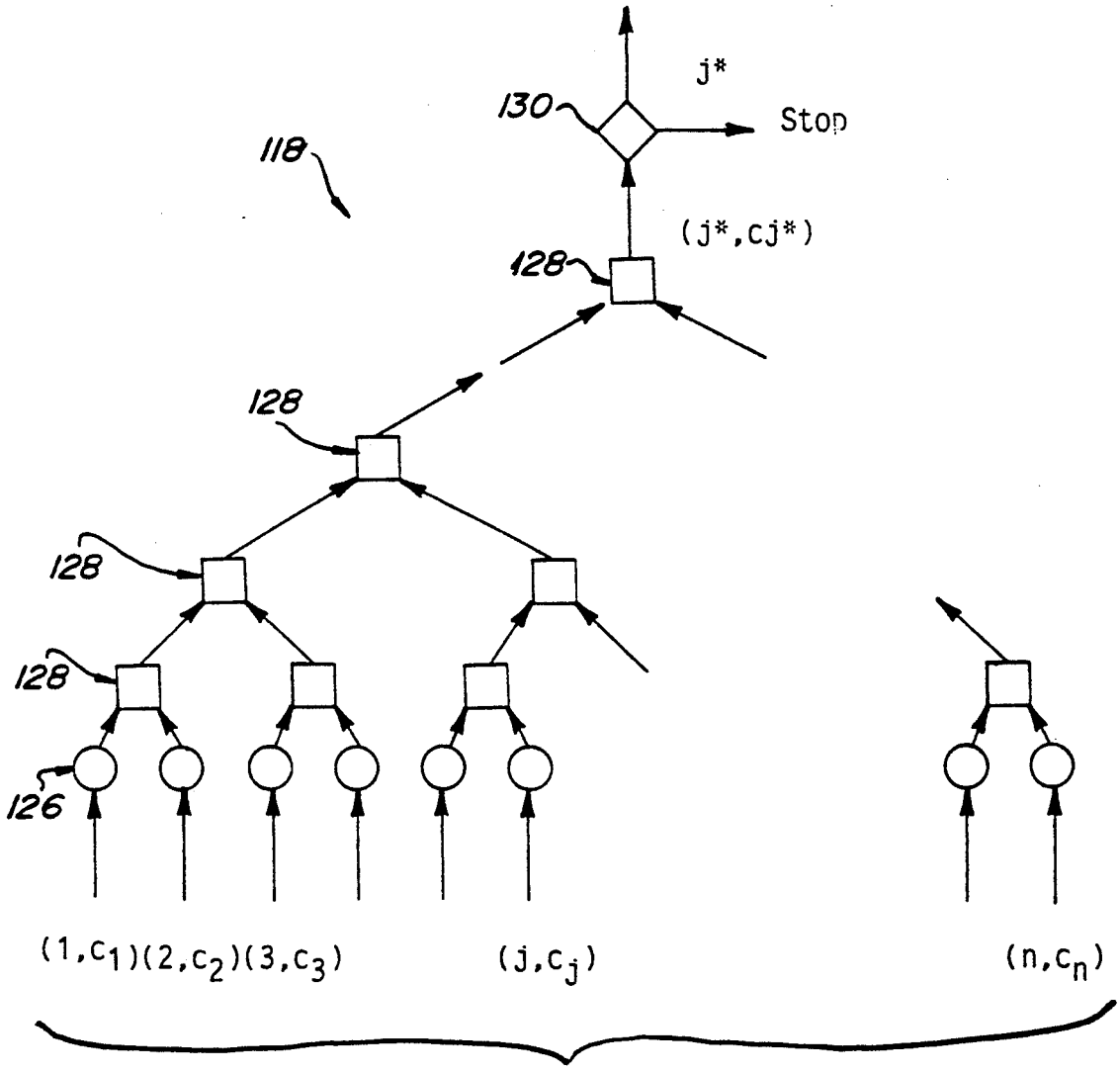
FIG. 9 is a block diagram of an architecture for performing step 2 of the flowchart shown in FIG. 7.

Because these operations are simple, there are many choices of such architectures. FIG. 8 describes one efficient way to process Step 1. A column selection circuit 116 includes a first row of input units 120 which receive the read-off signal and, if needed, converts its form. The "j" labels can be carried implicitly or explicitly. Comparator units 122 have two processing units 120 as inputs and have a single output. The comparator units determine the larger of its two inputs ($c_j$, $c_k$), and passes on the associated set to its output; that is j, $c_j$. Each comparator unit 122 performs this function until the uppermost comparator unit 122 passes its output to a zero comparator unit 124 which compares the given "c" value to zero. If c equals zero, then the zero comparator unit 124 sends a stop signal; indicating that an optimal solution has been found. Otherwise it passes on the appropriate index "j*". It will be appreciated that the column selection circuit 116 could also be implemented in software by the microcontroller 12 shown in FIG. 1; it is readily implementable on a VLSI chip and can be adjoined to the above described optical architecture. A similar circuit is described in FIG. 9. In particular, FIG. 9 shows row selection processor 118 which includes a row of input logical units 126 that receive the read-off signal and, if needed, converts its form. The unit then forwards, for example, $r=-1$ if "a" is not positive. If a is greater than zero and b equals zero, then the units 126 forward $r=M$ where "M" is a large positive number ("infinity"). Finally, if a is greater than zero and b is greater than zero, then the units 126 forward $r=b/a$. The "i" labels can be carried implicitly or explicitly. Pairs of logical units 126 are connected to comparator units 128 which determine the larger of its two inputs, for example, $r_i$, $r_k$, and passes on the associated set, i, $r_i$, to the next higher level. Finally, the last comparator unit 128 transmits its output to a zero comparator 130 that compares the given "r" value to zero. If r is less than zero then the unit sends a stop signal indicating that the problem is unbounded. Otherwise it passes on the appropriate index "i ". This performs the minimum ratio test, Step 2 in FIG. 7. With the added architecture, we thus have the capacity to solve general linear programming problems by Dantzig's Simplex method implemented in its classical tabular form. At each iteration we use the optical processor 100 shown in FIG. 6 or some other outer-product architecture, to perform the Gaussian pivot after we use the added architecture to choose the pivot element.

For the preferred embodiment, however, we do not suggest the above implementation that uses the regular Gaussian pivots; instead, we propose to use the pivots with back substitution. Note that if Simplex algorithm is applied to a linear programming problem in the Dantzig's tabular form, equation (15), a large identity submatrix I needs to be stored in memory and carried throughout the computations (pivots only "move this matrix around"). Using the pivots with back substitutions, however, allows us to treat this submatrix implicitly. Thus, on a typical general linear programming problem, we can save 40–60% of our silicon "real estate". We also avoid the cumulation of numerical error in the off-diagonal portion of I.

The price to pay for these benefits is mild. Assume that the $m \times n$ matrix M represents a linear program in the appropriate form. Store the vector of unique labels, for instance, 1, 2, . . . , n, in a vector $\lambda$ associated with the columns of M, and store the rest of such labels, $n+1$, $n+2, \ldots, n+m$, in a vector $\mu$ associated with the rows of M. Thus, initially, $\lambda^{(o)}(j)=j$ for all j and $\mu^{(o)}Oi)=n+i$ for all i. Each time we perform the pivot with back substitution, we interchange the labels of the pivot row and pivot column. For instance, if on the $k+1$-th iteration we pivot on row i and column j, then $\lambda^{k+1)}(j)=\mu^{(i)}(i)$ and $\mu^{(k+1)}(i)=\lambda^{(k)}(j)$. These labels are used to recover the optimal primal and dual solution when the algorithm terminates.

Another reason for using the pivots with substitution is that then our architecture can be also used to solve the so-called linear complementarity problems. See the incorporated by reference document by R. W. Cottle, Quadratic Programming, Academic Press. This important extension of linear programming can be used to find the solutions of quadratic programs, various competitive equilibria problems, and by extension, of many general nonlinear programming problems and systems of generalized nonlinear equations that arise in industrial settings. These problems take the form: given a matrix M and vector q, find a vector x such that $$x \geqq 0,\ w=q+Mx \geqq 0,\ and\ x^5 w=0. \tag{17}$$

Although, short of enumeration of a prohibitively large number of vertices of certain polyhedra, no general algorithm to solve all problems set forth in equation (17) is known, many important classes of linear complementarity problems are solvable by either Lemke algorithm or by Principal-pivoting method of Cottle and Dantzig. These powerful methods can be implemented on the augmented optical processor 100 architecture using pivots with substitution.

III. Optical Processor For Solving The Simplex Algorithm

Returning to FIG. 6, the optical processor 100 processes a linear programming problem in the standard form expressed in the tabular version as matrix M, $$M = \begin{array}{|c|c|c|} \hline c & o & z \\ \hline A & I & b \\ \hline \end{array}$$

where c is the objective function, A is a (rectangular) constraint matrix, I is the identity matrix, b is a nonnegative vector and z is the objective value.

Alternatively, processor 100 could process the same linear programming problem encoded in the form $$M' = \begin{array}{|c|c|} \hline c & z \\ \hline -A & b \\ \hline \end{array},$$

using the pivots with substitution. The appropriate submatrices of M and M' correspond.

We describe in detail the outer-product implementation for the linear program encoded in matrix M, because this form of encoding is generally more familiar. It will be appreciated, however, that the optical processor 100 can be used to solve linear programs in the form, $$M = \begin{array}{|c|c|} \hline c & z \\ \hline -A & b \\ \hline \end{array}$$

using pivots with substitutions. The necessary modifications, are two. First, row $i^*$ and column $j^*$ need to be read destructively while setting the light modulators. The row entries $a_{i^*j}$ and column entries $a_{ij^*}$ are on the vector-accumulator replaced by 0.

Second, with every row and column of M we associate a unique index. The indices of pivot row and pivot columns are interchanged at each pivot. This is best done in microcontroller 12. (Alternatively, we could just store the $i^*j^*$ pairs.)

The processor 100 includes first, second and third SLMs 36', 38', and 40', respectively, and a light source 14 arranged in a manner similar to that previously described. The SLM 40' differs from the SLMs 36' and 38' (which are similar to those described above in connection with FIGS. 2 through 5) in that it includes a single modulation area having a single transmissivity throughout its surface. The SLM 38' is divided into $2n-1$ columns of striped shaped unit cells for (orthogonal to the cells 106), and the SLM 36' is divided into $2n-1$ rows of striped shape unit cells 106 (orthogonal to the cells 104).

A light detector 17' is provided, which is divided into $(2n-1)^2$ light detection areas 108 arranged as a matrix array 2n−1 rows and 2n−1 columns. The detection areas 108 provide detector signals in response to light modulated by respective modulation areas of the modulators 38', 36', 40'. The physical correspondence between the modulation areas 104, 106 and the detection areas 108 may be clearly seen in FIG. 6. Detector signals from the areas 108 are each provided (via for example, lines 112) to a corresponding location 110 in the accumulator 16'. The accumulator 16', which may be integrated with the detector 17' as a single device contains a total of $(2n)^2$ locations 110 arranged as a matrix of 2n rows and 2n columns. The $(2n-1)^2$ unshaded locations 110 shown in FIG. 6 correspond to the respective $(2n-1)^2$ detector areas 108 of detector 17'. The shaded location 110 represent additional left column and top row of accumulator locations. The accumulator 16' is used for storing, adding and shifting the detector signals. The detector signals are proportional to the product of the signals modulating the corresponding areas of the SLMs 40', 38' and 36', as explained above.

The operation of the processor 100 is as follows. Signals representing all of the elements of matrix A are provided, via bus 81, to the accumulator 16', where they are stored in locations that are analogous to a mapping of the matrix A. After matrix A is loaded into the accumulator 16' the followings steps take place. First, the column selection processor 116 determines j* in accordance with step one of FIG. 7 and as described in FIG. 8. Alternatively step 1 may be performed by the microcontroller 12. Next, the row selection processor 118 performs step 2 as described in FIG. 7 in accordance with the methods shown in FIG. 9. Alternatively the row selection may be performed by the microcomputer 12. Once the column j* and the row i* are selected, the processor can proceed to step three to perform the Gaussian pivot on i*, j* entry of m. In more detail, the matrix term $a_{i^*j^*}$ is then determined and a signal representing $1/a_{i^*j^*}$ is transmitted along data line 114 to the SLM 40'. As a result, the entire area of SLM 40' will have a transmissivity such that it modulates light 14 by the expression $-1/a_{i^*j^*}$.

Next, the elements in matrix A of the j* column are provided as modulation signals to the SLM 36'. Likewise, the matrix elements in row i* are provided as modulation signals to the SLM 38'. The resultant modulated light is detected in area 108 of detector 17'. The detector signals from areas 108 are provided to the unshaded locations 110 of accumulator 16', where they are added to the corresponding element signals previously stored therein. This operation performs the Gaussian pivot so that the accumulator now holds $a-\alpha_i\beta^T i/\alpha_{i^*j^*}$. The above process is repeated until an optimal solution is found as indicated by c=0 in step 1 in FIG. 7.

Figure 10:
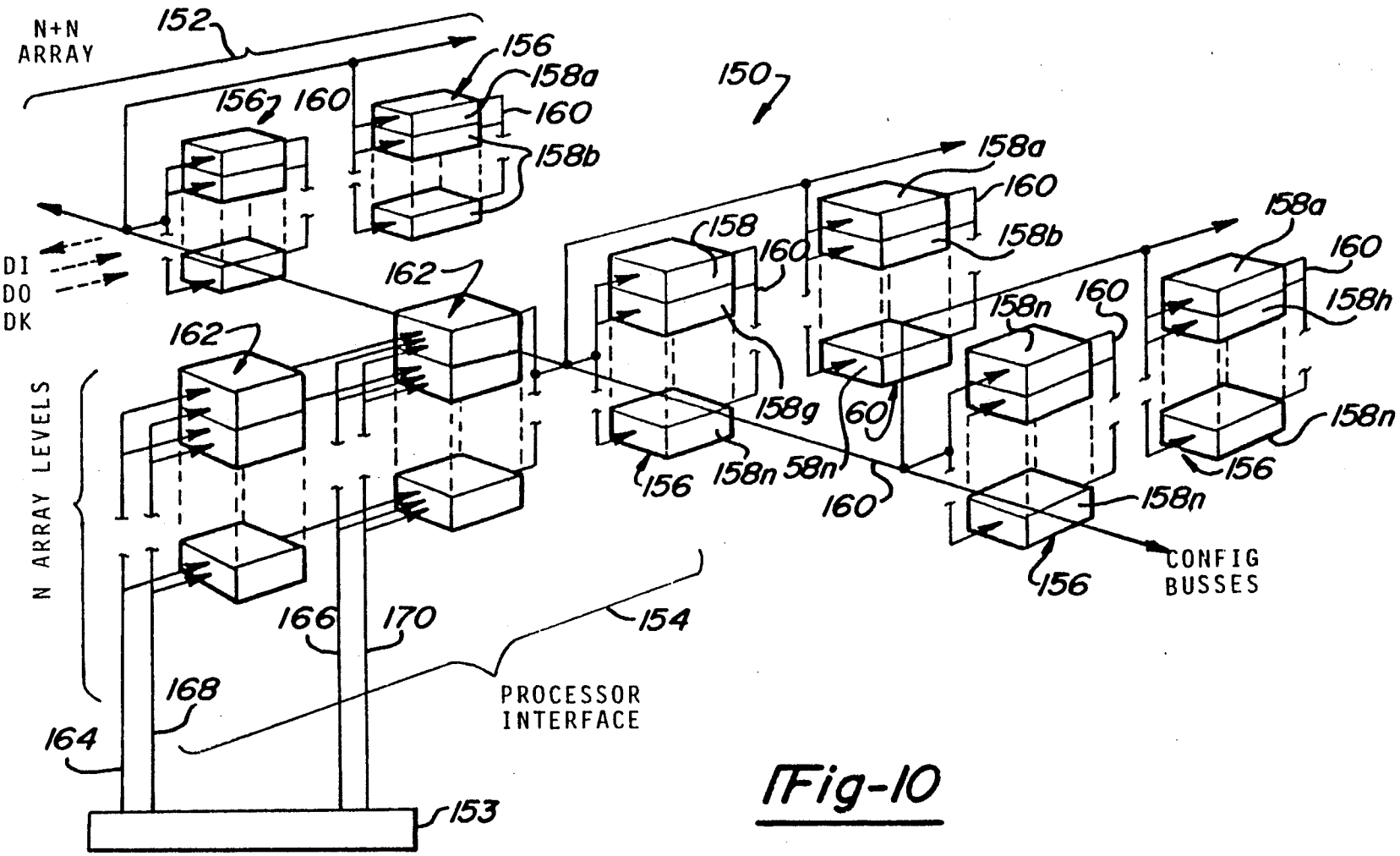
FIG. 10 is a block diagram of a cellular array processor for solving linear programming problems in accordance with the present invention.

Referring now to FIG. 10 there is shown a cellular array processor which is described in more detail in the above referenced U.S. Pat. No. 4,697,247 which is incorporated by reference. It will be appreciated that the above techniques for solving linear programming problems utilizing the optical processor described in FIGS. 1 through 9 can be applied equally to the cellular array processor in FIG. 10. Specific modifications to the cellular array processor shown in FIG. 10 that would be required, include means to perform steps 1 and 2 of FIG. 7, e.g., the processors described in FIG. 8 and 9. In more detail, FIG. 10 shows a cellular array processor 150 that is comprised of two principal components: an array processor 152 and a control processor 153 that is used to direct the operation of the array processor. In addition a processor interface 154 is provided for controlling the array processor 162. The control processor 153 must be capable of supplying all of the signals necessary to interface with the array processor interface 154 for controlling the array processor 161. The array 162 is comprised of a plurality of elemental processors 156 that are distributed as cells within a rectangular N×N array, thereby topologically matching the distribution of the data points present within any two-dimensional data set. The elemental processors 156 are essentially identical, each being composed of a plurality of modules 158 operatively interconnected by a data exchange subsystem utilizing a common data bus 160. Architecturally, the elemental processors 156 informing the array processor 152, occupy a three-dimensional space, wherein the modules 158 are distributed on a plurality of array levels that are parallel to and overlie one another. The elemental processors 156 extend in parallel across these array levels so that each contains a module in the corresponding N×N module arrays present on the different array levels.

The processor interface 154 is comprised of a plurality of individual interface circuits 162 which are present in each array level and consist of address decoders and configuration latches, the inputs of each being connected to the control processor 153 by address bus 164 and control bus 166. In addition, the control processor 153 provides an address valid signal on the address valid line 168 for indicating that the address and its corresponding control word are stable in their respective buses. Finally, it must be capable of providing a configuration latch reset signal on the reset line 170 for resetting the bits of all the configuration latches present in the processor interface 154 to their inactive states. Further details of the cellular array processor 150 may be found in U.S. Pat. No. 4,697,247.

It should also be noted that the above techniques can be applied to the barrier method of Karmarkar discussed above. Specific modifications which would be required to the above described architecture to perform the Karmarkar algorithm would include means to perform Step 2 of FIG. 7, e.g., the processor described in FIG. 8. It will be appreciated that as a result of the O(1) computational complexity of Gaussian pivot, we can essentially solve the general purpose linear programming problems in a linear expected time in accordance with the present invention. That is, with O(m) average-case computational complexity, where m denotes the number of constraints. This statement is based on the observation that, in order to reach a solution, the edge following algorithms (simplex) usually require 1.3 m–3 m Gaussian pivots; the interior point algorithms (Karmarkar) require 30–60 matrix inversions, each consists of m pivots. Thus, the present invention greatly improves the speed of the solution of linear programming problems since the current linear programming implementations require on average, an $O(m^3)$ number of steps.

In view of the foregoing, those skilled in the art should appreciate that the present invention provides a method and apparatus for solving linear programming problems with great speed and that the invention can be used in a wide variety of applications. The various advantages should become apparent to those skilled in the art after having the benefit of studying the specifications, drawings and following claims.

What is claimed is:

1. Apparatus for optically processing a linear programming problem represented in standard tabular form by a matrix A defined by matrix M, matrix I, row c, column b, and element z, said apparatus comprising:

means for determining a j*th column in matrix A, wherein said i*th column is the column in matrix A containing the largest number currently in row c;

means for determining an i*th row in matrix A, wherein said i*th row is the row in matrix A containing values producing a minimum value of the ratio $b_{i*}/a_{ij*}$;

first modulation means for spatially modulating an optical beam in response to signals representing numbers in n elements in the i*th row of said matrix A, and having a first set of modulation areas arranged in n rows;

second modulation means for spatially modulating the optical beam exiting the first modulator means in response to signals representing m elements in the j*th column of matrix A, and having a first set of modulation areas arranged in m columns;

third modulation means for spatially modulating the optical beam exiting the second modulator means in response to a signal representing a number equal to $-1/a_{i*j*}$;

light detector means having n×m light detection areas arranged as a matrix array of n rows and m columns, wherein the detection areas provide an array of detector signals in response to light modulated by respective modulation areas of a first, second and third modulation means, each element in the array of detector signals being proportional, respectively, to the product of a respective element in the i*th row, a respective element in the j*th column, and the number $-1/a_{i*j*}$;

accumulator means for storing the values of matrix A and for updating the values of matrix A by adding subsequent detector signals to previously stored values;

means for providing the current n elements in the i*th row of matrix A to the first modulation means;

means for providing the current m elements in the j*th column of matrix A to the second modulator means; and means for providing a signal representing the current number $-1/a_{i*j*}$ to the third modulation means.

2. The apparatus of claim 1 further comprising:

control means for determining if the largest number currently in row c is zero and, if so, for identifying the elements of matrix A as an optimal solution if the largest number is zero.

3. The apparatus of claim 2, wherein said control means further comprises means for determining if the minimum ratio $b_i/a_{ij*}$ is less than zero and for labeling said linear programming problem as unbounded where this ratio is less than zero.

4. The apparatus of claim 1, further comprising controller means for processing said linear programming problem by means of a simplex-type algorithm.

5. The apparatus of claim 1, wherein said means for determining a j*th column in matrix A further comprises:

a row of input units each receiving an element of row c;

a first row of comparators for receiving signals from two comparator means in the first row and for determining and transmitting the larger of the two inputs, whereby the largest number in row c is determined; and comparator means for determining if the largest value found is equal to zero, whereby said apparatus can determine when an optimal solution is found.

6. The apparatus of claim 1, wherein said means for determining the minimum ratio $b_{j*}/a_{i*j*}$ further comprises:

a row of input units for receiving $b_i$ and $a_{ij*}$ values and for calculating the ratio $r=b_i/a_{ij*}$ and transmitting the resultant ratio r;

a first row of comparators for receiving signals from two input units and for determining and transmitting the larger of its two inputs;

a second row of comparator means for receiving signals from two comparators in the first row and for determining and transmitting the larger of the two, whereby the largest ratio r in matrix A is determined; and comparator connected to the last comparator to receive signals, for determining if r is less than zero, whereby said apparatus can determine if said linear programming problem is unbounded.

7. Apparatus for processing a linear programming problem, said problem represented by a matrix of elements of said problem, said apparatus comprising:

input means for receiving signals representing said elements of said linear programming problem;

storage means for storing said elements received by said input means in matrix form;

processor means for performing a series of matrix operations on said elements to reach a solution to said linear programming problem;

said processor means including a plurality of processing elements for simultaneously performing a complete matrix operation on said elements;

output means for transmitting said solution of the linear programming problem;

controller means for implementing said matrix operations as Gaussian pivot operations to solve said linear programming problem in accordance with a Simplex-type method: and wherein said processor means further includes:

a light source which emits a two-dimensional light beam along an optical path;

a plurality of light modulators for spatially modulating the optical beam in response to signals representing said elements including a light modulator having a uniformly modulating area for uniformly modulating the entire light beam modulated in response to signals representing said elements;

a light detector means for providing detector signals in response to light modulated by said modulator means; and accumulator means for storing said detector signals.

8. Apparatus for processing a linear programming problem, said problem represented by a matrix of elements of said problem, said apparatus comprising:

input means for receiving signals representing said elements of said linear programming problem;

storage means for storing said elements received by said input means in matrix form;

processor means for performing a series of matrix operations on said elements to reach a solution to said linear programming problem;

said processor means including a plurality of processing elements for simultaneously performing a complete matrix operation on said elements;

output means for transmitting said solution of the linear programming problem;

controller means for implementing said matrix operations as Gaussian pivot operations to solve said linear programming problem in accordance with a Karmarker-type method; and wherein said processor means further includes:

a light source which emits a two-dimensional light beam along an optical path;

a plurality of light modulator s for spatially modulating the optical beam in response to signals representing said elements including a light modulator having a uniformly modulating area for uniformly modulating the entire light beam modulated in response to signals representing said elements;

a light detector means for providing detector signals in response to light modulated by said modulator means; and accumulator means for storing said detector signals.

9. A method of processing a linear programming problem, said problem represented by a matrix of elements of said problem, said method comprising the steps of;

receiving signals representing said elements of said linear programming problem;

storing said elements received in matrix form;

performing a series of matrix operations on said elements to reach a solution to said linear programming problem, by simultaneously performing a series of complete matrix operations, wherein said matrix operations are implemented with controller means for implementing said matrix operations as Gaussian pivot operations to solve said linear programming problem in accordance with a Simplex-type method;

transmitting said solution of the linear programming problem; and wherein the step of performing further includes the steps of transmitting a two-dimensional light beam along an optical path;

modulating said light beam in response to signals representing said elements of said linear programming problem;

modulating said modulating light beam in a uniformly modulated area, said area including all areas modulated in response to said elements of said linear programming problem;

detecting said modulated light beam;

transmitting signals in response to said detected light beam; and storing said detected signals.

10. A method of processing a linear programming problem, said problem represented by a matrix of elements of said problem, said method comprising the steps of:

receiving signals representing said elements of said linear programming problem;

storing said elements received in matrix form;

performing a series of matrix operations on said elements to reach a solution to said linear programming problem, by simultaneously performing a series of complete matrix operations, wherein said matrix operations are implemented with controller means for implementing said matrix operations as Gaussian pivot operations to solve said linear programming problem in accordance with a Karmarkar-type method;

transmitting said solution of the linear programming problem; and wherein the step of performing further includes the steps of transmitting a two-dimensional light beam along an optical path;

modulating said light beam in response to signals representing said elements of said linear programming problem;

modulating said modulated light beam in a uniformly modulated area, said area including all areas modulated in response to said elements of said linear programming problem;

detecting said modulated light beam;

transmitting signals in response to said detected light beam; and storing said detected signals.

11. A method of processing a linear programming problem represented in standard tabular form by a matrix A, defined by matrix M, matrix I, row c, column b, and element z, said method comprising:

determining a $J^*$th column in matrix A, wherein said $J^*$th column is the column in matrix A containing the largest number currently in row c;

determining an $i^*$th row in matrix A, wherein said $i^*$th row in the row in matrix A containing Values producing a minimum ratio $b_{i^*}/a_{ij^*}$;

spatially modulating an optical beam in response to signals representing numbers in n elements in the $i^*$th row of said matrix A, and arranging a first set of modulation areas in n columns;

spatially modulating the optical beam in response to signals representing m elements in the $j^*$th column of matrix A, and arranging a first set of modulation areas in m rows; spatially modulating the optical beam in response to a signal representing a number equal to $-1/a_{i^*j^*}$;

detecting said modulated optical beam in a light detector means having $m \times n$ light detection areas arranged as a matrix array of m rows and n columns, and providing an array of detector signals in response to light previously modulated, said signals being proportional, respectively, to the product of a respective element in the $j^*$th row, a respective element in the $j^*$th column, and the number $-1/a_{i^*j^*}$; and storing the values of matrix A after they are detected and updating the values of matrix A by adding the detected signals to the current values.

12. The method of claim 11, further comprising determining if the largest number currently in row c is zero and identifying the elements of matrix A as an optimal solution if the largest number is zero.

13. The method of claim 11, further comprising determining if the minimum ratio $b_i/a_{ij^*}$ is less than zero and labeling said linear programming problem as unbounded where this ratio is less than zero.

14. The method of processing a linear programming problem represented in standard dictionary form by a matrix A defined by submatrix -M, row c, column b, element z, and row and column of unique labels u and λ, respectively, by pivots with substitution, said method comprising:

determining a j*th column in matrix A, wherein said j*th column is the column in matrix A containing the largest number currently in row c;

determining an i*th row in matrix A, wherein said i*th row in the row in matrix A containing Values producing a minimum ratio $b_{i*}/a_{ij*}$;

spatially modulating an optical beam in response to signals representing numbers in n elements in the i*th row of said matrix A, and arranging a first set of modulation areas in n columns;

spatially modulating the optical beam in response to signals representing m elements in the J*th column of matrix A, and arranging a first set of modulation areas in m rows; spatially modulating the optical beam in response to a signal representing a number equal to $-1/a_{i*j*}$;

detecting said modulated optical beam in a light detector means having m×n light detection areas arranged as a matrix array of m rows and n columns, and providing an array of detector signals in response to light previously modulated, said signals being proportional, respectively, to the product of a respective element in the i*th row, a respective element in the j*th column, and the number $-1/a_{i*j*}$;

storing the values of matrix A after they are detected and updating the values of matrix A by adding the detected signals to the current values; and determining if the largest number currently in row c is zero and identifying said updated values of matrix A as an optimal solution if the largest number is zero.

15. The method of claim 14, further comprising determining if the minimum ratio $b_i/a_{ij*}$ is less than zero and labeling said linear programming problem as unbounded where this ratio is less than zero.

* * * * *

UNITED STATES PATENT AND TRADEMARK OFFICE

CERTIFICATE OF CORRECTION

PATENT NO. : 5,185,715

DATED : February 09, 1993

INVENTOR(S) : K. ZIKAN ET AL

It is certified that error appears in the above-identified patent and that said Letters Patent is hereby corrected as shown below:

Column 15:

Claim 1, line 9, delete "I" and insert instead --j--.

Column 17:

Claim 8, line 16, take the space out between "modulator" and "s" to read --modulators--.

Column 18:

Claim 11, lines 28, and 29, delete "J" and insert instead --j--; and line 27, delete "j" and insert instead --i--.

Column 19:

Claim 14, line 14, delete "J" and insert instead --j--.

Signed and Sealed this

Twelfth Day of September, 1995

*Attest:*

Bruce Lehman

BRUCE LEHMAN

*Attesting Officer*

*Commissioner of Patents and Trademarks*